US005836135A

United States Patent [19]

Hagan et al.

[11] Patent Number: 5,836,135

[45] Date of Patent: Nov. 17, 1998

[54] DRAINAGE TRACK

[76] Inventors: Joseph R. Hagan, 1391 Pinellas Rd., Belleair, Fla. 34616; Kim DeVormer, 3133 Honeywood La., Apt. C, Roanoke, Va. 24014; Fred Hansen, 6005 NW. 100 Way, Parkland, Fla. 33076-2579

[21] Appl. No.: 792,597

[22] Filed: Jan. 31, 1997

[51] Int. Cl.[6] ..... E04F 17/00; E04B 2/00

[52] U.S. Cl. ..... 52/730.1; 52/58; 52/302.3

[58] Field of Search ..... 52/58, 169.5, 302.1, 52/302.3, 302.6, 730.1; 405/36, 39, 43, 45

[56] References Cited

U.S. PATENT DOCUMENTS

| | | | |
|---|---|---|---|
| 1,976,166 | 10/1934 | Friedberg | 52/302.6 |
| 2,264,961 | 12/1941 | Ward . | |
| 2,645,824 | 7/1953 | Titsworth | 52/302.3 |
| 2,703,002 | 3/1955 | Suskind | 52/302.3 |
| 3,850,193 | 11/1974 | Guzzo | 52/169.5 X |
| 4,569,872 | 2/1986 | Miller . | |
| 4,570,398 | 2/1986 | Zimmerman . | |
| 4,745,716 | 5/1988 | Kuypers | 52/169.5 X |
| 4,773,195 | 9/1988 | Waller | 52/169.5 |
| 4,837,991 | 6/1989 | Shaw | 52/169.5 X |
| 4,869,032 | 9/1989 | Geske | 52/302.3 |
| 5,501,044 | 3/1996 | Janesky | 52/169.5 |
| 5,511,346 | 4/1996 | Kenworthy . | |
| 5,519,969 | 5/1996 | Golba | 52/58 X |

*Primary Examiner*—Lanna Mai
*Assistant Examiner*—Kevin D. Wilkens
*Attorney, Agent, or Firm*—Pettis & Van Royen, P.A.

[57] ABSTRACT

A drainage track useful in combination with exterior insulation and finish systems including a clog-resistant drainage channel so that water collecting behind the exterior insulation and finish may drain from the structure. The drainage track, in a preferred form, is extruded from PVC and defines a substantially L-shaped configuration in cross-section. An elongated, relatively tall flashing leg is provided for attachment of the drainage track to the structure such that all water resistant material and insulation laps over the flashing leg to direct water into the drainage channel. Finish apertures are provided through a portion of the drainage track so that exterior finish such as, for example, stucco, will readily adhere and bond to the drainage track.

6 Claims, 3 Drawing Sheets

DRAINAGE TRACK

BACKGROUND OF THE INVENTION

1. Field of the Invention

The present invention relates to a drainage track of the type primarily intended for use in combination with exterior insulation and finish systems (generally referred to in the construction industry as EIFS), the construction of which provides for positive drainage of moisture which may collect between a structure's exterior surface or coating and its weather resistant barrier.

2. Description of the Prior Art

In today's construction industry, numerous residential structures, and even a significant number of commercial structures such as, for example, apartment buildings, have their exterior surfaces finished with a stucco-type coating applied over a foam insulation board. One such board is, for example, that disclosed in U.S. Pat. No. 4,572,865, and other such boards are well known in the prior art and in the construction industry. Such exterior finishes are generically referred to as Exterior Insulation and Finish Systems, and will be referred to hereinafter as EIFS.

While such EIFS constructions have proved to be quite satisfactory for their relative ease of installation, their insulating properties, and their ability to receive a variety of aesthetically-pleasing finishes, a serious and vexing problem associated with EIFS construction exists. This problem is one of water accumulation behind the exterior wall covering. Such water may be the result of condensation, but is frequently the result of wind-driven water that may enter behind the exterior wall covering at any point where the exterior surface of the coating is penetrated. Such water accumulation may be the result of poor workmanship or design, deterioration of flashing or sealants over time, lesser quality doors or windows, or any other penetration or compromise of the exterior finish.

When such water penetration occurs, absent effective, reliable means for draining the water from behind the EIFS exterior construction, structural damage to the building may occur.

The construction industry has certainly recognized such problems associated with water penetration behind EIFS exteriors, and other insulated building components such as, for example, windows. For example, U.S. Pat. No. 4,569,872 describes an insulating window panel which includes a bottom frame member for draining condensation. According to the disclosure of that patent, a transparent plastic sheet having a number of vertical channels formed therethrough is disposed in face-to-face relationship with a polyethylene closed cell foam sheet. The purpose of the vertical channels is to permit water to flow downwardly, and the lower frame member is dimensioned and configured to provide a drain opening along the bottom thereof. This drain opening is provided by insuring that the composite panel is mounted in spaced apart relation to the bottom of the frame member.

U.S. Pat. No. 2,264,961 discloses a thermal insulation structure having vertical channels formed on one face thereof to provide a ventilating space for the circulation of air to dry out water which may penetrate the insulating material. However, this patent does not disclose or suggest any means for positively draining water from inside the wall.

According to the disclosure of U.S. Pat. No. 4,570,398, concrete may be sprayed onto the exterior of rigid sheet insulation and wire to form a continuous waterproof outer surface. However, one may reasonably question such a statement, for concrete is typically permeable to water.

Finally, U.S. Pat. No. 5,511,346 discloses a rigid, thermoplastic foam board useful in below-grade residential and commercial insulating and drainage applications. According to the disclosure of this patent, the board includes a plurality of vertical channels formed therein to provide for water drainage and to protect a below-grade building wall from excessive moisture.

Without in any way questioning the asserted utility of the devices and structures identified above, any practical study of these devices reveals significant shortcomings. Virtually none of the prior art devices actually provides means for positively draining water away from the building structure. While a drain opening is provided in the panel disclosed by U.S. Pat. No. 4,569,872, establishing that drain opening clearly requires care and precision in fitting the lower frame member to the composite panel. While the other devices discussed above provide means for "ventilating" insulating panels, none provide for water drainage from behind the panels. It is, therefore, clear that there remains a great need in the art of building constructions utilizing EIFS exteriors so as to provide for the drainage of penetrating water from behind the insulation so as to prevent water-related structural damage to the building. Such a device must not only provide for positive water drainage, but also must be of economical manufacture and of relatively simple use and installation so as not to adversely affect building costs.

SUMMARY OF THE INVENTION

The drainage track of this invention is of the type primarily intended for use in combination with exterior insulation and finish systems (EIFS). The principal purpose of the drainage track is to provide positive means for draining water from behind the insulating material so as to prevent water-related structural damage to the building. The drainage track comprises a flashing leg by which the track is attached to the exterior sheathing of the building along the bottom edge of that sheathing. A major portion of the flashing leg overlaps the sheathing, and a minor portion of the flashing leg extends below the sheathing's bottom edge. Extending in angular relation from the bottom edge of the flashing leg is a first structural web. In a preferred embodiment, a second structural web is joined to the first web and extends in angular relation thereto in substantially parallel relation to the flashing leg and upwardly from the first web. A horizontal leg is joined to the second web and extends in angular relation thereto, outwardly from the flashing leg. Thus, in cross-section, the drainage track defines a substantially L-shaped configuration with a drain channel defined by the lower portion of the flashing leg, the first structural web, and the second structural web. The horizontal leg defines a surface for placement of an insulating panel thereon.

A plurality of drain apertures are formed in the first web to provide for positive drainage of water therefrom. A plurality of finish apertures are preferably formed through the horizontal leg so as to permit proper adhesion of the building's stucco-type exterior finish, which finish is applied to the exterior surface of the insulating panel according to known procedures and techniques. Alternatively, the horizontal leg can also incorporate other adhesion promoting means, such as ridges or a combination of ridges and apertures for proper adhesion.

In this preferred embodiment, the drainage track is formed from extruded polyvinyl chloride (PVC). However, the scope of the invention is not to be limited to the use of this material. Any suitable material such as, for example, other plastics or metals, may be used for forming the drainage track. In similar fashion, the cross-sectional configuration described above is nothing more than a preferred embodiment, and alternative configurations will be presented hereinafter.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
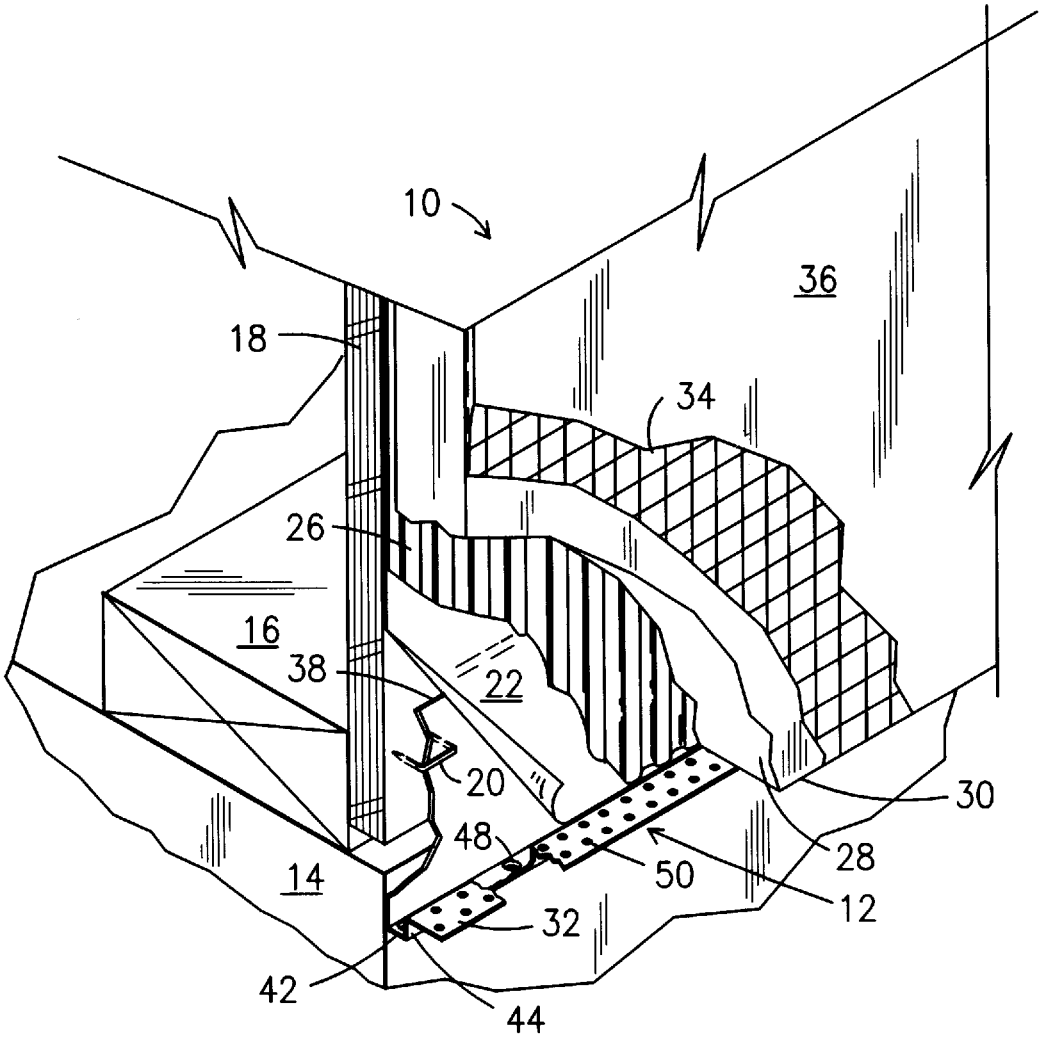
FIG. 1 is a perspective view, partially in section to show interior detail, of an EIFS wall construction showing use and installation of the drainage track of this invention according to a preferred embodiment.
Figure 2:
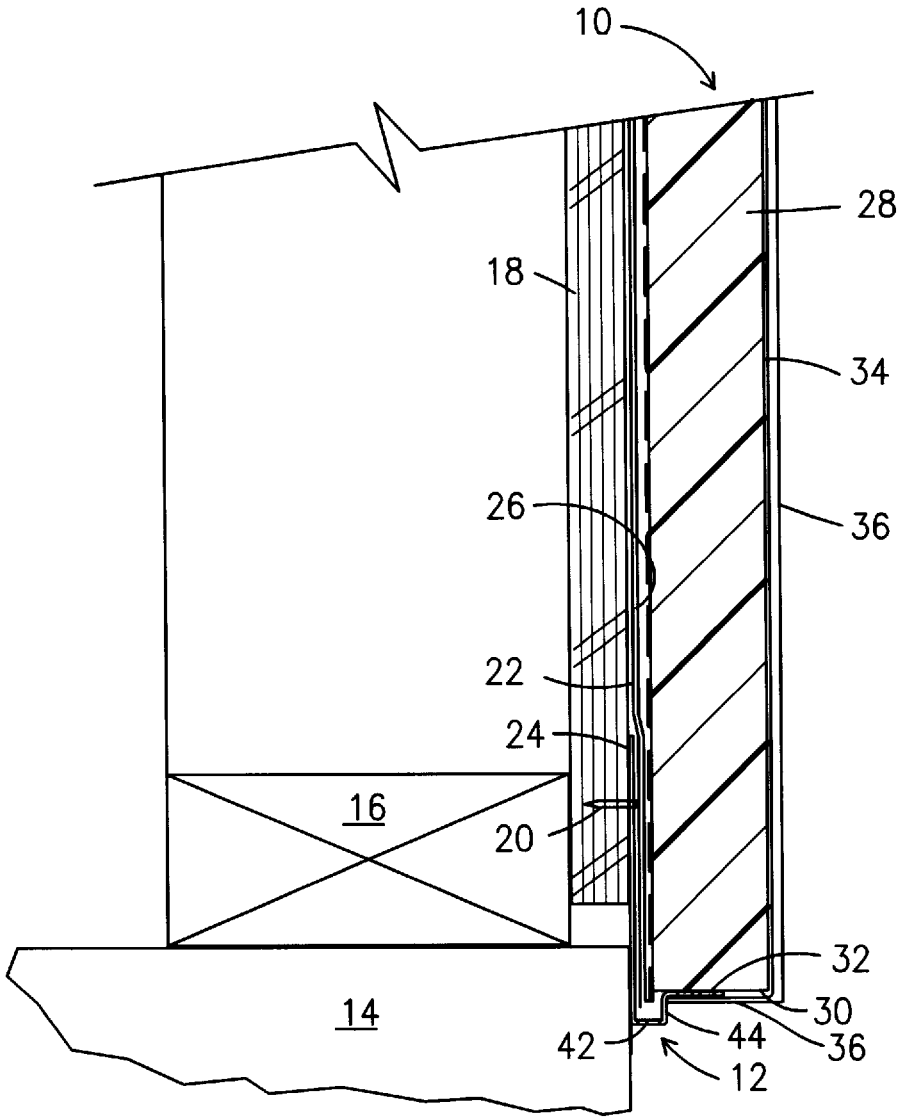
FIG.2 is a sectional view of the installation shown in FIG. 1.
Figure 3:
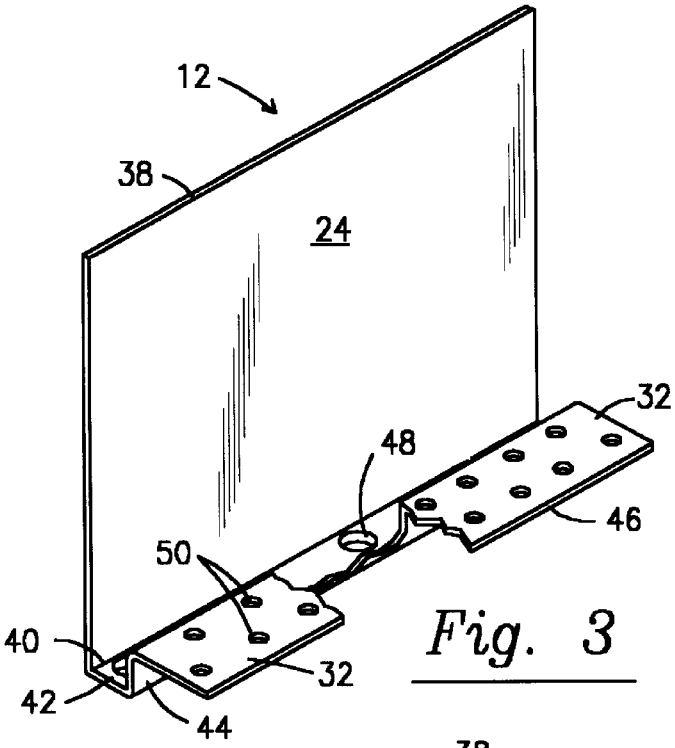
FIG.3 is a perspective view of a segment of the drainage track used in the installation of FIG. 1.
Figure 4:
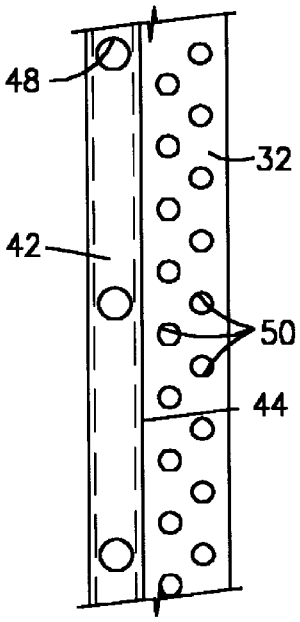
FIG. 4 is a bottom, plan view of the drainage track of FIG. 3.
Figure 5:
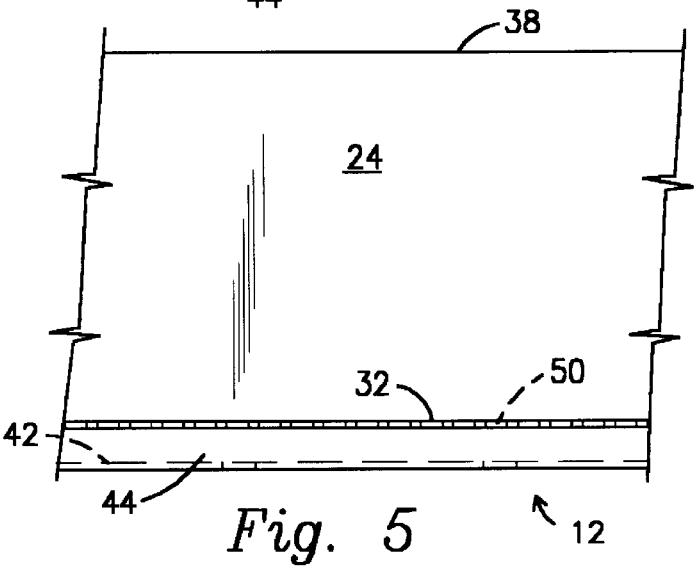
FIG. 5 is a front elevation of the drainage track of FIG. 3.

Referring first to the views of FIGS. 1 and 2, one sees a perspective and a sectional view of a portion of a standard building construction, the exterior of which is finished with an exterior insulation and finish system (EIFS), generally indicated as 10. The drainage track of this invention is generally indicated as 12. The building segment shown in FIGS. 1 and 2 comprises a slab, or foundation, 14 having a sole or sill plate 16 attached thereto. Using studs (not shown), the exterior of the building is initially formed by sheets of sheathing 18. The EIFS 10, in combination with the drainage track 12 of this invention, is actually attached to sheathing 18.

As seen in the view of FIG. 1, drainage track 12 is attached to sheathing 18 as by staples 20, or any such suitable fastening means such as, for example, nails, brads, or screws. Next, a weather resistant barrier 22 is applied over sheathing 18 such that the lower portion of barrier 22 overlaps flashing leg 24 of drainage track 12. Spacers 26 are next applied over barrier 22, and the bottom portion of spacers 26 also overlaps flashing leg 24. Insulating material 28 is next applied. The bottom portion of insulating material 28 also overlaps flashing leg 24. Referring to the view of FIG. 2, it can be seen that the bottom edge 30 of insulating material 28 actually rests on horizontal leg 32 of drainage track 12. The view of FIG. 1 further illustrates that the exterior of insulating material 28 is provided with a reinforcing mesh 34. Finally, the finish coat 36 is applied over the exterior of insulating material 28 and its mesh 34 to complete the installation. Referring to the view of FIG. 2, it can be seen that finish coat 36 actually "wraps around" the bottom edge 30 of insulating material 28 and onto the bottom surface of horizontal leg 32.

Having thus described a standard installation utilizing drainage track 12 in combination with the EIFS 10, attention is invited to the fact that the subject matter of this invention is directed to drainage track 12. That is to say, drainage track 12 is useful in combination with virtually any EIFS 10, and the individual elements of such an exterior finish may certainly vary from job to job. For purposes of example only, weather resistant barrier 22 is typically a type 15 felt, or an equivalent. Spacers 26 may be ¼"×3½" closed-cell polyethylene sill sealers, ½" diameter closed-cell backer rods, or their equivalents. Virtually any commercially-available insulating board may be used as the insulating material 28, and the board described in U.S. Pat. No. 4,572,865 is preferred. The finish coat 36 may be any coating/sealant as specified for application to and compatibility with insulating material 28. Sheathing 18 may be plywood, gypsum, cement board, fiberboard, or other equivalents therefore. It is to be understood that local conditions and building codes will, at least to some extent, dictate the individual components of EIFS 10.

Having thus described a typical EIFS 10 used in combination with drainage track 12 of this invention, attention is now invited to the views of FIGS. 3–6 for a more detailed description of a preferred construction for drainage track 12. As previously indicated, drainage track 12 is preferably extruded from PVC. However, drainage track 12 may be formed from any suitable, substantially rigid material such as, for example, other plastics, other synthetics, or metal. As perhaps best seen in the views of FIGS. 3 and 6, drainage track 12 comprises a flashing leg 24 having a top edge 38 and a bottom edge 40. A first structural web 42 is joined to bottom edge 40 and extends in angular relation thereto. In this preferred embodiment, first structural web 42 is substantially normal to flashing leg 24. A second structural web 44 extends from first web 42 in angular relation to first web 42. Again, as shown in this preferred embodiment, second structural web 44 is substantially normal to first structural web 42 and extends upwardly in the direction of top edge 38 such that second structural web 44 is substantially parallel to flashing leg 24. Horizontal leg 32 is joined to the top of second web 44 and extends in angular relation to second web 44, terminating in a distal edge 46.

A plurality of drain apertures 48 are formed in spaced apart relation through first structural web 42. A plurality of finish apertures 50 are formed in spaced apart relation through horizontal leg 32.

Figure 6:
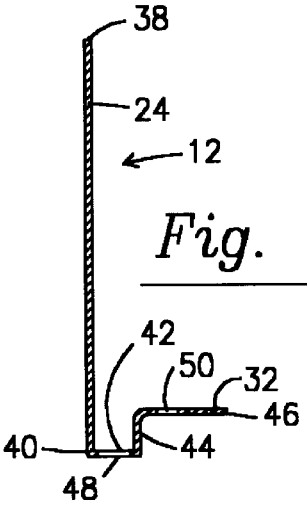
FIG. 6 is a side sectional view of the drainage track of FIG. 3.

Referring to the sectional view of FIG. 6 and the sectional installation view of FIG. 2, it can be seen that a portion of flashing leg 24 adjacent bottom edge 40, first structural web 42, and second structural web 44 effectively define a drain channel for positively draining any water that penetrates the EIFS 10. Referring to the view of FIG. 2, the top of this drain channel is actually defined by bottom edge 30 of insulating material 28, inasmuch as that bottom edge 30 rests on horizontal leg 32.

In the preferred embodiment, drain apertures 48 are about 3/16" in diameter, and finish apertures 50 are about ⅛" in diameter. This size for drain apertures 48 ensures that water will pass therethrough and not be retained in the drain channel as by surface tension, while is of a sufficiently small size to prevent the entry of pests. The smaller size and greater number of finish apertures 50 provide for effective bonding of the finish coat 36 to horizontal leg 32. Though not shown in the drawings, it may be desirable to form the bottom surface of horizontal leg 32 to include a plurality of ridges, further enhancing the bonding between horizontal leg 32 and finish coat 36.

It should also be noted that the distance between flashing leg 24 and second web 44 plus the distance defined between second web 44 and distal edge 46 is less than the thickness of the EIFS 10 used in combination with drainage track 12. Thus, a variety of EIFS 10 constructions may be used in combination with a single drainage track 12 with the exterior of the insulating material 28 extending beyond distal edge 46.

As indicated above, this construction for drainage track 12, as heretofore described and as shown in the drawing figures, is but a preferred embodiment. First structural web 42 need not necessarily be normal to the plane defined by flashing leg 24, and second structural web 44 need not necessarily be normal to the plane defined by first structural web 42. For example, first web 42 and second web 44 could define a V-shaped drain channel, rather than the substantially rectangular channel shown in the sectional view of FIG. 6. The scope of this invention is intended to encompass such a construction, and drain apertures 48 might then be said to be formed through both the first structural web and the second structural web. In similar fashion, the shapes of first web 42 and second web 44 might be altered to define a curved, substantially U-shaped drain channel with drain apertures formed through the bottom of the U. In all instances, however, flashing leg 24 is attached to the building such that the entire EIFS 10 overlaps top edge 38 of flashing leg 24 so that water will necessarily be directed toward the drain apertures 48. Similarly, horizontal leg 32 will always be spaced apart from flashing leg 24 and define a top, planar surface suitable for operatively receiving bottom edge 30 of the insulating material 28.

A key advantage of the drainage track of this invention is that the outer portion of its drainage channel, e.g., structural web 44 of the embodiment shown in the drawings, serves as a block to prevent clogging of the drain apertures. If the drainage track were to simply be an L-shaped device, without an upwardly projecting and blocking member such as web 44, the installer, in applying the coating and reinforcing mesh over the lower edge of the construction, would tend to plug the drainage holes with the coating because there would be no guide limiting how far back his trowel could go. Thus, the track would become ineffective. Structural web 44 or any equivalent step portion therefore plays a key role by serving as a "guide" in limiting how far back the plasterer pushes his trowel with the coating. This guide prevents him from going all the way back to the substrate (slab 14) and filling the vent holes with coating.

It will thus be seen that the objects set forth above, among those made apparent from the preceding description, are efficiently attained, and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A drainage track of the type primarily intended for use with exterior insulation and finish systems, said drainage track comprising: a flashing leg comprising a top edge and a bottom edge; a first structural web joined to said flashing leg and extending in angular relation from said flashing leg bottom edge; a second structural web joined to said first web and extending in angular relation to said first web toward said top edge; and an horizontal leg joined to said second web and extending in angular relation to said second web, said horizontal leg comprising a distal edge opposite said second web and said horizontal leg further comprising a plurality of finish apertures formed therein; and said first web comprising a plurality of drain apertures formed therein.

2. A drainage track as in claim 1 wherein said first web extends in substantially normal relation to said flashing leg.

3. A drainage track as in claim 2 wherein said second web extends in substantially normal relation to said first web in the direction of said leg top edge.

4. A drainage track as in claim 3 wherein said horizontal leg extends in substantially normal relation to said second web away from said flashing leg.

5. A drainage track as in claim 1 wherein said drain apertures define a first diameter that is greater than a second diameter defined by said finish apertures.

6. A drainage track of the type primarily intended for use with exterior insulation and finish systems, said drainage track comprising:

a flashing leg comprising a top edge and a bottom edge;

a first structural web attached to said bottom edge and extending outwardly therefrom in substantially normal relation to said flashing leg, said first web comprising a plurality of drain apertures formed therein;

a second structural web attached to said first web and extending therefrom in substantially normal relation to said first web in the direction of said leg top edge such that said second web is in spaced apart, substantially parallel relation to said flashing leg; and an horizontal leg attached to said second web and extending therefrom in substantially normal relation to said second web, said horizontal leg comprising a distal edge opposite said second web, and said horizontal leg further comprising a plurality of finish apertures formed therein;

each of said drain apertures defining a first diameter that is greater than a second diameter defined by each of said finish apertures.

* * * * *